United States Patent [19]

Anderson et al.

[11] Patent Number: 5,006,228

[45] Date of Patent: Apr. 9, 1991

[54] MOUNTING SYSTEM FOR INCREASING THE WEAR LIFE OF A VIBRATING SCREEN PANEL

[75] Inventors: Thomas A. Anderson, Placerville, Calif.; Richard G. Kalar, Coon Rapids, Minn.; Reinhold S. Markfelt, Moundsview, Minn.; Walter R. Wagner, Minneapolis, Minn.

[73] Assignee: Johnson Filtration Systems Inc., New Brighton, Minn.

[21] Appl. No.: 464,929

[22] Filed: Jan. 16, 1990

[51] Int. Cl.[5] ..... B07B 1/46

[52] U.S. Cl. ..... 209/365.3; 209/400; 209/403; 209/405

[58] Field of Search ..... 209/400, 401, 403, 405, 209/365.3, 399; 160/380

[56] References Cited

U.S. PATENT DOCUMENTS

| | | | |
|---|---|---|---|
| 1,997,740 | 4/1935 | Nickerson | 209/403 |
| 2,271,900 | 2/1942 | Mowbray | 209/403 |
| 2,274,700 | 3/1942 | Jenks | 209/401 |
| 3,029,946 | 4/1962 | Wright, Jr. et al. | 209/405 |
| 3,795,311 | 3/1974 | Martin | 209/399 X |
| 3,929,647 | 12/1975 | Kempa | 209/395 |
| 4,137,157 | 6/1979 | Deister et al. | 209/403 |
| 4,288,320 | 9/1981 | Wilson | 209/382 |
| 4,341,627 | 7/1982 | Heilhecker | 209/409 |
| 4,529,510 | 7/1985 | Johnson et al. | 209/403 |
| 4,735,712 | 4/1988 | Herren et al. | 209/403 |
| 4,840,728 | 6/1989 | Connolly et al. | 209/405 |

FOREIGN PATENT DOCUMENTS

| | | | |
|---|---|---|---|
| 568768 | 7/1932 | Fed. Rep. of Germany | 209/403 |
| 2813630 | 10/1979 | Fed. Rep. of Germany | 209/403 |
| 493600 | 10/1938 | United Kingdom | 209/403 |
| 509591 | 3/1939 | United Kingdom | 209/403 |

*Primary Examiner*—Donald T. Hajec

*Attorney, Agent, or Firm*—Barry L. Clark

[57] ABSTRACT

Mounting system for substantially increasing the wear life of a screen panel which is adapted to be vibrated, utilizes elastomeric material, such as urethane, to isolate the vibrating mechanism from direct contact with the screen panel. An elastomeric wear strip is bonded to screen wires on the underside of the screen panel. A recessed channel formed in the bottom of the wear strip is adapted to engage an upper contact surface of a rigid vibrating bar member, while the side edges of the channel extend downwardly over the sides of the rigid vibrating bar member to prevent abrasive material which has passed through slots in the screen panel from entering the contact area between the recessed channel and the upper contact surface. The upper contact surface of the vibrating bar member is preferably covered with elastomeric material and crowned so as to cause the screen panel to become curved when its side edges are forced down by a pair of hold-down bars. Contact between the hold-down bars and the screen panel and contact between the ends of the vibrating bar member and the side walls of the screen box assembly is preferably made through layers of elastomeric material. The hold-down bars preferably include angled wedge-shaped portions on their upper surfaces which cooperate with angled brackets on the side walls of the screen box assembly to force the side edges of the screen panel downwardly. Flow diverter strips are provided at the ends of the screen panel to prevent material which has flowed through the screen slots from leaving the screen box.

17 Claims, 2 Drawing Sheets

MOUNTING SYSTEM FOR INCREASING THE WEAR LIFE OF A VIBRATING SCREEN PANEL

BACKGROUND OF THE INVENTION

The invention relates to self-supported profile wire flat deck screen panels mounted on a screen support assembly to dewater and classify materials, and particularly to arrangements for mounting said panels so that they can be used in a vibrating apparatus. The screen panels typically comprise a plurality of parallel stainless steel wires which are each welded to an underlying series of spaced apart support rods or bars positioned normal to the wires. A principal use for such screen deck panels is in taconite processing plants, where the screen panels are used to help separate taconite ore from silicates and carbonates.

Taconite is a fine grained sedimentary rock of magnetite, hematite and quartz, mined as a low-grade iron ore. The taconite is a very hard rock that possesses a small amount (about 21%) of magnetic iron. The process and equipment used to extract the iron from the rock is quite complicated since the rock is a solid mass, much like a solidified lava flow. This rock must be blasted into chunks, transported from the mine to the processing plant and crushed to the consistency of face powder before the magnetic particles of iron can be separated from the waste rock. The rock is crushed to near size and is then mixed with water and transported as a slurry through piping to a screen box assembly. The slurry flows over the screen surface, which is typically positioned at about a 45°-60° angle to the horizontal, and the properly sized material which passes through the slots in the screen is then transported as a slurry to large magnetic rotating drums. The magnetic particles of iron are attached to the drums while the non-magnetic waste material continues on to waste sediment ponds. The magnetic particles are scraped off the rotating drums and again mixed with water and transported as a slurry to a further processing stage. Any oversized material which cannot pass through the screen slots continues to flow over the top surface of the screen and is returned to the crushers for further size reduction. Because the slot openings in the screens are quite fine, typically 0.003"-0.006", they are prone to blinding or plugging due to surface tension and the consistency of the taconite slurry. When the slots get plugged, the material which is of a small enough size to ordinarily pass through the slots cannot pass through them and thus remains mixed in with the oversized particles that flow over the screen surface. Since the material that does not pass through the slots is returned to the crushers for reprocessing, it is obvious that production is lost and energy is wasted when screen sized particles do not pass through the slots. To overcome the aforesaid plugging or blinding which greatly reduces the efficiency of the screening operation, it has been found to be necessary to rap or vibrate the screen at timed intervals. The vibration clears the slot openings, but has created other problems. The main problem is that the wear life of the screen panel and/or the screen box assembly which supports it, is greatly reduced. This is a result of the fact that prior art constructions typically require that the screen and its framing be welded together and that a vibrator mounting plate then be welded to the rods of the screen. A vibrator or rapper is then bolted to this assembly. The vibrations which are produced can result in an unpredictable wear life for the assembly. Although it is desirable that the wear life of a screen panel be determined by the time it takes for abrasion of the particles passing through it to widen the slots defined by the screen wires to an unacceptable dimension, the typical failure mode is breakage at the weld joints. Since such breakage renders the assembly useless, the entire assembly has to be discarded, resulting in an unacceptable economic loss. Wear is also greatly increased by the fact that, typically, a tremendous quantity of very hard taconite is processed, such as more than 100,000 tons per day.

Similar screen systems are used in the coal industry except that in the coal process, the fines which pass through the slot openings go to waste while the oversize material is the useful product that continues on for further processing.

There are a number of U.S. patents which appear to disclose structure wherein there is direct contact of a vibrating metal screen member by an element having an elastomeric contact surface, including: Kempa U.S. Pat. No. 3,929,647; Deister et al U.S. Pat. No. 4,137,157; Wilson U.S. Pat. No. 4,288,320; Heilhecker U.S. Pat. No. 4,341,627; Johnson et al U.S. Pat. No. 4,529,510; and Connolly et al U.S. Pat. No. 4,840,728. We have found, however, that when a vibrator bar having an elastomeric upper contact surface is placed directly under the support rods of a metal screen panel, that there is substantial abrasion produced which can cause the screen to fail long before the width of the flow slots has been increased to an unacceptable dimension by the passage of the abrasive material through them. In addition to the aforementioned patents, Wright, Jr., et al U.S. Pat. No. 3,029,946 shows a resilient mount for a clamp while Herren et al U.S. Pat. No. 4,735,712 shows laminating a layer of elastomeric material to a metal member to shield the metal member from abrasion.

SUMMARY OF THE INVENTION

It is among the objects of the present invention to provide a screen mounting system for a screen support assembly which offers greatly enhanced wear. Another object is to provide a system in which the screen panel can be easily and quickly installed in and removed from the support assembly not only during its initial installation or replacement, but also at periodic intervals when it is desirable to turn the screen end for end to increase its wear life and efficiency. A still further object is to provide a system in which no part of the vibrating mechanism is welded to the screen panel. Yet another object is to provide a system in which the material which passes through the screen slot openings will be prevented from mixing with oversize material which has been retained on the upper surface of the screen panel. These and other objects are achieved by the screen mounting system of the present invention in which an elastomeric material such as urethane is used throughout in order to avoid direct metal-to-metal contact between relatively moving parts, or even, in the case of the screen panel, urethane-to-metal contact. The screen panel is provided with a transversely positioned urethane wear strip attached to its bottom surface by bonding or adhesive, for example. A relatively wide recessed channel in the bottom of the wear strip is adapted to overlie and contact the upper crowned surface of a rigid vibrator bar which is mounted between the opposed sides of the screen box assembly. The recessed channel has a width which is greater than the thickness of the upper surface of the vibrator bar which it contacts, and is preferably 150-300% of the thickness of said upper surface. This extra width allows a certain tolerance in assembling the wear strip to the screen panel and the screen panel to the screen box assembly. It also provides a tolerance which helps to ensure that the recess in the wear strip will engage the upper surface of the vibrator bar when the screen panel is periodically reversed in position. The sides of the recessed channel are defined by a pair of downwardly extending leg portions which serve to isolate the region of contact between the upper surface of the vibrator bar and the lower surface of the recessed channel. This keeps the abrasive particles in the slurry from getting between the relatively moving vibrator bar and wear strip, thereby eliminating such particles as a source of wear. The presence of the wear strip provides a very substantial improvement as compared to a prior construction in which a urethane-coated vibrator bar was permitted to directly bear against the under surface of the screen rods of a screen panel. Not only does the wear strip eliminate the presence of abrasive particles from the region of contact but it also has a very elongated, continuous contact surface, as compared to the relatively slight degree of contact area that is available when spaced screen rods contact the vibrator bar directly. The wear resistance of the assembly is further increased by providing the upper surface of the vibrator bar with a coating of urethane, so that there will be a urethane-to-urethane interface rather than a metal-to-urethane one. Urethane caps positioned on the ends of the rigid vibrator bar provide isolation between the bar and a pair of support members attached to the sides of the screen box assembly. Urethane foam diverter strips are mounted at the ends of the screen panel between the lower surface of the wires and an upper mounting strip on the screen box assembly for a purpose which will be hereinafter described. The screen panel is held in place in the screen box by a pair of hold-down bars which extend for the length of the screen panel. The hold-down bars are encapsulated in urethane and have a flat bottom which presses down on the screen panel. To facilitate assembly, the hold-down bars preferably include a plurality of upwardly extending angled portions. During assembly, the hold-down bars are moved longitudinally in the direction of the length of the screen panel until the upwardly extending angled portions engage, in a wedge-like manner, a plurality of similarly angled brackets affixed to the side panel portions of the screen box assembly. Other means to fasten the hold-down bars to the side panels of the screen box assembly could also be used, such as bolts, for example. In the latter position, the angled urethane portions and the angled brackets cooperate to wedge the screen panel downwardly into its assembled operative position in the screen box assembly. The design, being in one large piece, eliminates the danger that multiple separate pieces such as bolts, or separate bars and wedge members, could get lost. The hold-downs can also be installed and removed very quickly. A wide plate which is affixed to the bottom of the rigid vibrator bar is preferably provided with a pair of elongated slots through which bolts are placed to fasten a vibrator or rapping apparatus to the vibrator bar. The design makes it quite easy to periodically reverse the direction of the screen panel at intervals of 400 hours, for example, throughout its approximate 4000 hour life, so as to keep the leading edge of the screen wires as sharp as possible, thus maximizing their efficiency. Since the screen box assembly is usually used so that one end of the screen panel is tilted upwardly at about a 45°-60° angle, the presence of the urethane foam diverter strips at each end of the screen panel insures that no matter which end of the screen panel is directed downwardly, the flow along the underside of the screen panel will not pass out between the screen rods at the end of the panel, but will be diverted downwardly with the rest of the flow which has passed through the screen slots.

DETAILED DESCRIPTION OF THE PREFERRED EMBODIMENT

Figure 1:
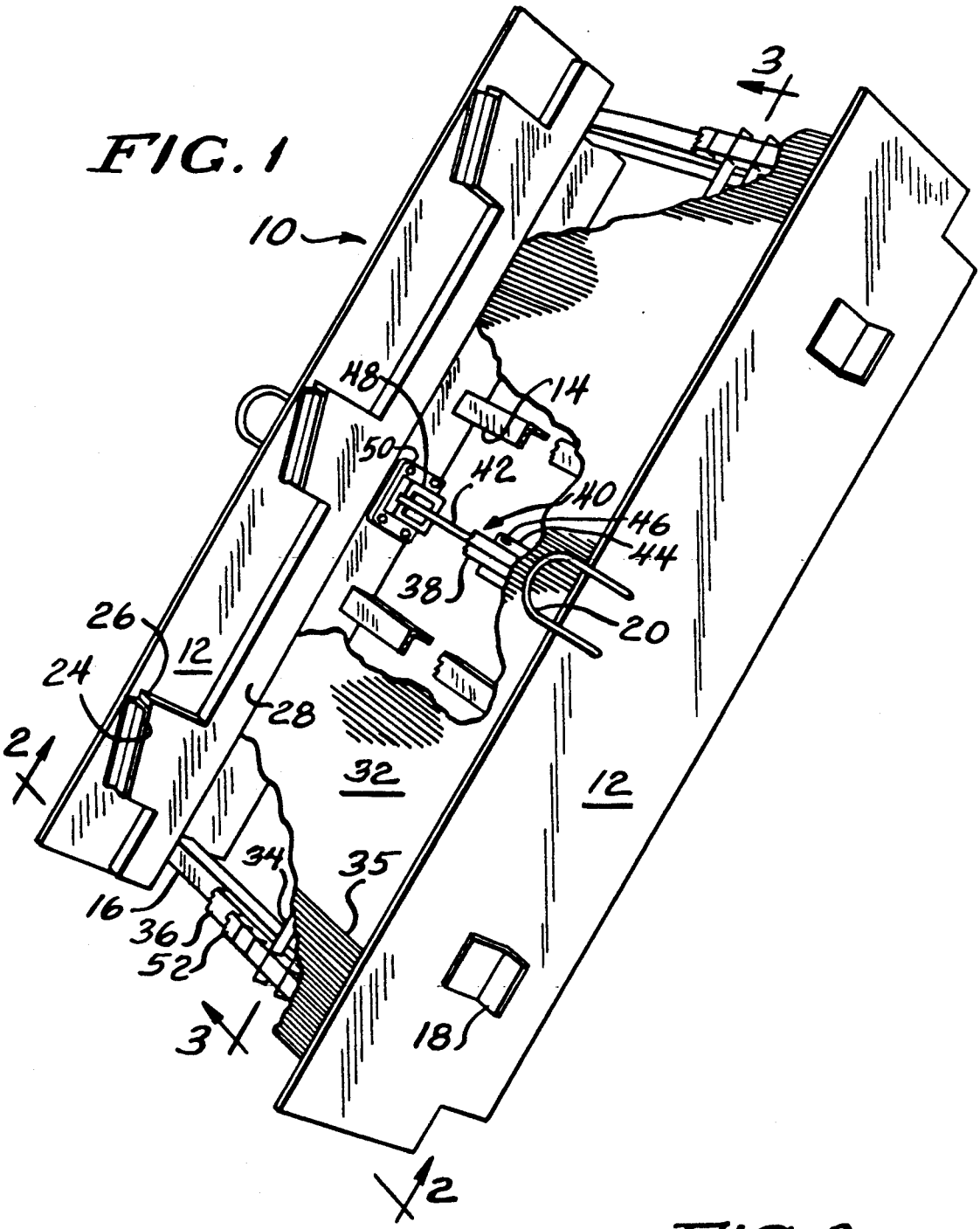
FIG. 1 is a partially broken away perspective view of an assembly of a screen box, a screen panel, and various portions of our improved mounting system which permits the panel to be vibrated.

Referring to FIG. 1, the screen box assembly indicated generally at 10 can be seen as including a pair of spaced vertical side panels 12 which are joined together to form a framework by a pair of intermediate cross support members 14 and a pair of end cross support members 16. A pair of support brackets 18, which are welded to the outer surfaces of each of the panels 12, permit the screen box assembly to be supported by the frame of a taconite processing apparatus, not shown. A pair of lifting rings 20 are welded to the side panels 12. The rings 20 are adapted to receive a bar, not shown, which can be lifted by a crane when it is necessary to move the screen box assembly. A plurality of angled hold-down brackets 24 are integrally attached to inner surfaces of the side panels 12. These brackets 24 serve as stops which cooperate with the angled wedge portions 26 which are preferably provided at the top of the urethane coated hold-down bars 28. The wedging action which is produced between brackets 24 and wedge portions 26 as the hold-down bars 28 are moved from right to left, forces the hold-down bars 28 down against the side edges of the screen panels 32. The screen panels 32 are formed of a plurality of closely spaced wires 33 which are welded to a plurality of spaced screen support rods 34 to form flow slots 35. The bottoms of the screen support rods 34 are supported, and vibrationally isolated from the screen box assembly, by a pair of urethane support strips 36 which are mounted on the upper surfaces of the end cross support members 16. The central portion of the screen panel 32 has an elastomeric screen wear strip 38, preferably formed of urethane, bonded or otherwise attached to the rods 34 on its underside. Mounted under the wear strip 38 is a vibrator bar assembly 40 comprising a rigid vibrator bar portion 42 which has a vibrator mounting plate 44 welded or otherwise affixed to its lower surface. Slots 46 in the mounting plate 44 are adapted to receive bolts, not shown, for retaining a vibrator assembly, not shown. The vibrator bar assembly 40 is retained at each of its ends by a pair of vibrator bar support members 48 which are mounted to the side panel members 12 by a plurality of bolts 50. Diverter strips 52, which are preferably formed of polyurethane foam, have a series of spaced slots which closely engage the rods 34 at each end of the screen panel 32. These diverter strips 52 serve to seal the ends of the screen box and the ends of the screen panels 32. Accordingly, any liquid flow which passes through the screen wires 33, and along either the inside surface of the screen panel or along the screen rods 34, will be prevented from leaving the inside of the screen box assembly. The diverter strips 52 provide a seal since they are compressed between the underside of the screen wires 33 and the urethane support strips 36. A plurality of bolts 56 located at each end of the screen box assembly are used to anchor the end cross supports 16 to the urethane support strips 36.

Figure 2:
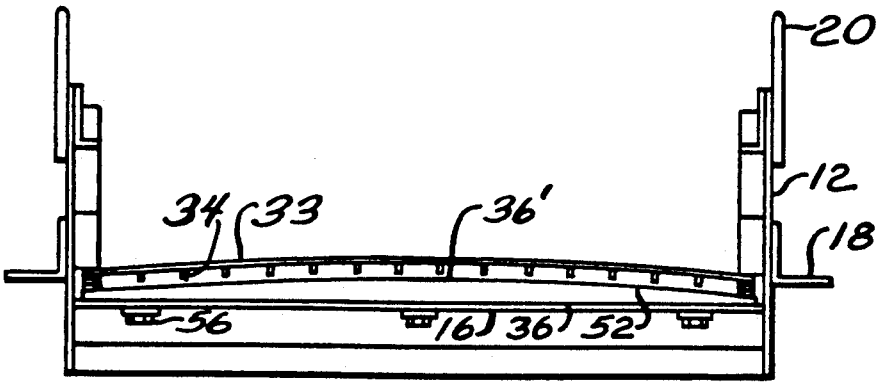
FIG. 2 is an end view taken in the direction indicated by the lines 2—2 in FIG. 1.

FIG. 2 shows an end view of the screen box assembly 10 taken in the direction shown by the lines 2—2 in FIG. 1. In this view it can be seen that the screen panel 32 is crowned in its center. This crowning is achieved by forming a complementary crown on the upper surface 36' of the urethane strip 36, and by bending the normally flat screen panel 32 to conform to it by using the hold-down bars 28 to force its edges down. This figure also shows how the foam diverter strip 52 fills the space between the underside of the screen wires 33 and the upper surface of the urethane support strip 36 and is in engagement with the side surfaces of each of the screen rods 34.

Figure 3:
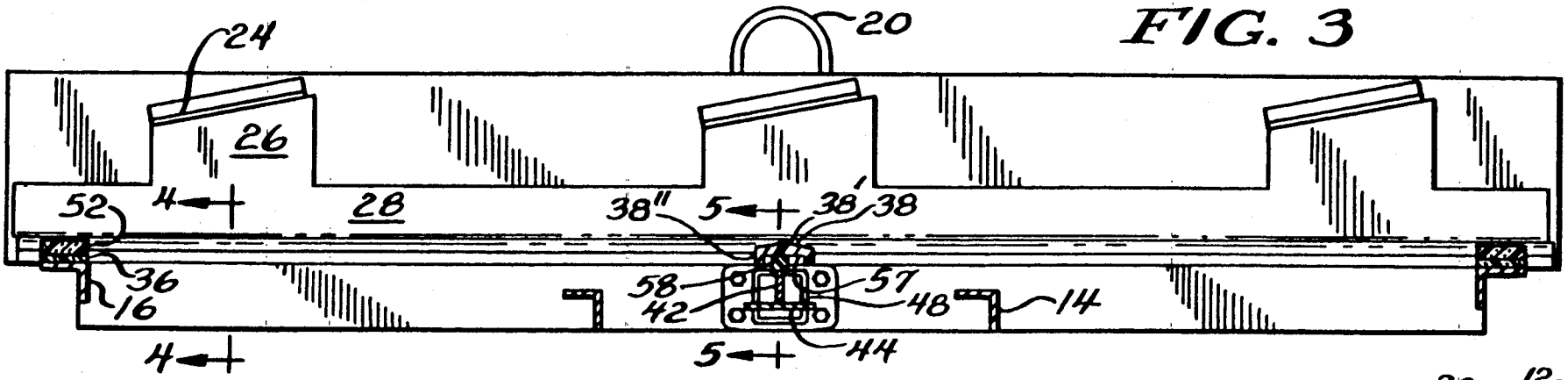
FIG. 3 is a cross-sectional view taken on lines 3—3 of FIG. 1.

FIG. 3 is a cross-sectional side view taken along lines 3—3 of FIG. 1. It shows the sealing that is provided at the ends of the screen box assembly by the foam diverter strips 52 and the urethane support strips 36. Since the screen box assembly is normally used in an angled position of 45°-60° from the horizontal, as illustrated in FIG. 1, it is obvious that any flow of material that has passed downwardly through the screen slots 35 and moved to the left along the under surface of the screen wires 33 or along the rods 34, will flow down along the end cross support member 16 where it can be collected with the remainer of the material which has passed through the slots 35. This is important, since it prevents all of the already sized material from being mixed back together with the non-sized material that flows off the left edge of the top surface of the screen panel 32. The non-sized material is normally recycled for further crushing and screening. FIG. 3 also shows another very important feature. This is the elastomeric wear strip 38 which has a rather thick upper portion 38' which is slotted to receive the screen rods 34, as seen best in FIGS. 4 and 5. The wear strip 38 is preferably integrally attached to the screen panel 32 by being bonded or adhesively fastened to the screen rods 34. The underside of the wear strip 38 includes a relatively wide channel portion 57 which is preferably at least about 50% wider than the width of the vibrator bar 42 or any coating of urethane 58 which might be provided on the top of the vibrator bar 42, and even more preferably about 300% wider. This substantial width of the channel portion 57 provides a tolerance for variations in the mounting of the wear strip 38 to the screen panel 32. It also provides a tolerance to accommodate the periodic reversal of the screen panel 32 within the screen box assembly 10. The wear strip 38 has side leg portions 38'' which define the width of the channel portion 57 and extend sufficiently far down so that at least the vast majority of the material which passes down through the slots 35 of the screen panel will be shielded from the region of contact between the lower contact surface of the channel portion 57 and the upper contact surface of the vibrator bar 42. Although good wear would be provided if the metal vibrator bar 42 were in direct metal-to-urethane contact with the lower contact surface of the channel portion 57, since the leg portions 38'' can be expected to keep any abrasive particles away from the contact region, we prefer to provide a urethane-to-urethane contact by molding a urethane coating or layer 58 to the top of the vibrator bar 42.

Figure 4:
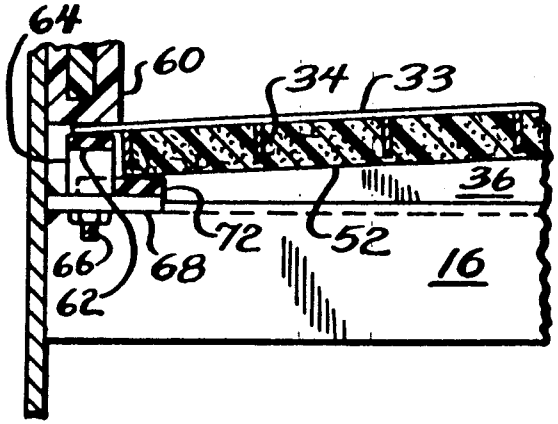
FIG. 4 is a fragmentary cross-sectional view taken on lines 4—4 of FIG. 3.

In FIG. 4, it can be seen that the hold-down bars 28 have a coating 60 of urethane, the lower surface of which is compressed into contact with the upper surface of the screen wires at the side edges of the screen panel 32. The downward pressure applied to the edges of the screen panel forces the panel to assume the crowned shape of the urethane support strips 36 as well as the crowned shape of the urethane coating 58 on the vibrator bar 42. It also forces the bottom surface of the screen wires 33 to compress the urethane strips 62 which are bonded or otherwise attached to the upper surface of a pair of steel support bars 64 which are in turn held by bolts 66 to a pair of horizontal plates 68 which are welded to the side panel members 12. Another pair of urethane strips 72 are bonded or otherwise attached to the horizontal plates 68 and serve to support those portions of the screen panel support rods 34 which overlie them.

Figure 5:
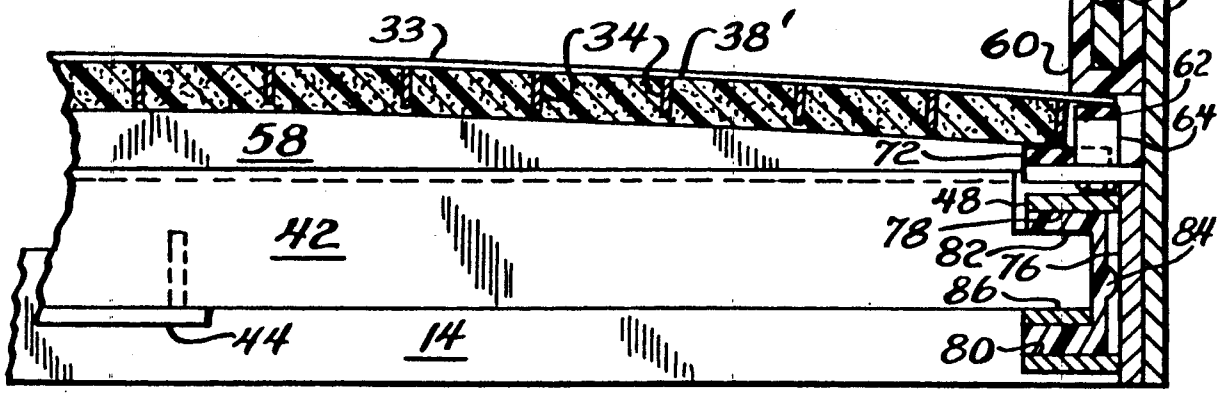
FIG. 5 is a fragmentary cross-sectional view taken on lines 5—5 of FIG. 3.

FIG. 5 is a cross-section taken on line 5—5 of FIG. 3, and illustrates the isolation mounting of the vibrator bar 42 relative to the vibrator bar support 48 which are integrally attached to the side panel members 12. The vibrator bar supports 48 include a vertical support plate 76, an upper plate 78 and a lower plate 80 which cooperate to form a hollow box which supports the urethane end caps 82 which are molded to the ends of the vibrator bar 42. A molded projection 84 on the end caps 82 acts as a shock absorber which helps to prevent axial relative movement between the vibrator bar member 42 and the vibrator bar supports 48. A small metal piece 86, which has a width in a direction transverse to the vibrator bar 42 which is greater than the thickness of the vibrator bar, is preferably welded to each end of the vibrator bar member 42 and is encapsulated in the urethane cap 82 in order to join said member and cap together.

As can be seen from the preceding description, the screen panel 32 is preferably completely isolated from the side panels 12 of the screen box assembly 10 by the urethane strips 62 and 72 and the urethane layer 60 on the hold-down bars 28. It is also isolated from direct metal-to-metal contact with the vibrator bar 42 by at least the wear strip 38, and also preferably by a urethane coating 58 on the vibrator bar 42. This isolation not only prevents vibration damage to the screen panel, but it also greatly reduces the power which must be provided by a vibrator (not shown) attached to the vibrator mounting plate 44 since the energy of the vibrator is directed principally into the screen panel rather than into the screen box assembly 10.

Although a particular construction of our invention has been disclosed, we intend that this is for the purpose of illustration and example only, and the scope of this invention is limited only by the following claims. It will be readily apparent that various features of our improved mounting system could be used to great advantage with various prior art screen panel mounting systems to obtain a considerable degree of improvement in the wear life or vibrating efficiency of such systems.

For example, our elastomeric coated hold-down bar could be used in various systems, including those wherein the screen panel has a vibrator directly attached to it, or those wherein a vibrator bar contacts the screen panel directly. In such uses, there would be a substantial increase in the speed and convenience of changing the screen panels. Furthermore, at the expense of some increase in power consumption, our feature of attaching an elastomeric wear strip to the bottom of a screen panel would increase the wear life of a screen panel even if the screen panel should be rigidly mounted in the screen box such that the screen box would also have to be vibrated.

We claim:

1. In a screen panel mounting system having a screen panel which includes a plurality of spaced wires which are welded to a series of spaced apart underlying support rod members positioned generally normal thereto so as to define a plurality of flow slots, and a screen box assembly having side walls and end wall portions for receiving and supporting said screen panel in its use position, the improvement comprising a vibrator bar assembly mounted to the opposed side walls of said screen box assembly; a vibrator support plate mounted to said vibrator bar assembly intermediate its end wall portion, said vibrator support plate being adapted to receive fastening means for attaching a vibrator thereto; said vibrator bar assembly including an elongated rigid bar portion having an upper contact surface; means for mounting said vibrator bar assembly to the opposed sides of said screen box assembly; an elongated elastomeric wear strip attached to the underside of said screen panel at a location wherein it will overlie and contact the said upper contact surface of said vibrator bar assembly, said wear strip having side portions which extend downwardly past at least a portion of the upper contact surface of said rigid bar portion so as shield said contact surface from possible contact with materials passing through the flow slots of said screen panel; and hold-down means for retaining said screen panel relative to the sides of said screen box assembly.

2. The screen panel mounting system of claim 1 characterized in that an elastomeric flow diverter strip is mounted at at least one end of the screen panel, said flow diverter strip including a plurality of spaced slots in its upper surface to accommodate the rod members of said screen panel and thereby permit said strip to fill the space between the lower surface of the wires of said screen and an underlying end wall portion of said screen box assembly.

3. The screen panel mounting system of claim 1 characterized in that said hold-down means comprises a pair of elongated hold-down bars positioned along the lengths of said opposed side walls of said screen box assembly, said hold-down bars being covered with elastomeric material and having a flat bottom surface which is adapted to overlie and resiliently contact the upper surface of the screen panel at the opposed sides thereof.

4. The screen panel mounting system of claim 1 characterized in that the upper contact surface of said elongated portion of said vibrator bar assembly has a crowned upper surface and is located at the center of said screen box assembly.

5. The screen panel mounting system of claim 1 characterized in that the elongated elastomeric wear strip which is attached to the underside of said screen panel is located at the center of said screen panel, said elastomeric wear strip being substantially wider than the width of the contact surface of said elongated rigid bar portion of said vibrator bar assembly and having an upwardly recessed channel portion formed in its lower surface which is at least 50% wider than the width of the contact surface of said elongated rigid bar portion of said vibrator bar assembly which contacts a portion of the upper surface of said recessed channel, the upper surface of said wear strip having a plurality of transverse slots therein which are adapted to receive and be bonded to the rod members of the screen panel, the downwardly extending side portions of said wear strip which form the sides of said recessed channel portion serving to divert and to help prevent material passing downwardly through the slots of the screen panel from contacting the upper contact surface portion of said elongated rigid bar portion of said vibrator bar assembly.

6. The screen panel mounting system of claim 1 characterized in that an elastomeric flow diverter strip is mounted at each end of the screen panel, each of said flow diverter strips including a plurality of spaced slots in its upper surface to accommodate the rod members of said screen panel and thereby permit said strips to fill the space between the lower surface of the wires of said screen and end wall portions of said screen box assembly.

7. The screen panel mounting system of claim 3 characterized in that the upper surface of said hold-down bars includes a plurality of angled portions which are adapted to resiliently engage the undersurface of a plurality of similarly angled rigid retainer members attached to the side walls of said screen box assembly, said angled portions and said angled retainer members cooperating with each other to wedge said screen panel into its operative position in said screen box assembly.

8. The screen panel mounting system of claim 1 characterized in that said means for mounting said vibrator bar assembly to the opposed sides of said screen box assembly includes a pair of support members attached to the opposed side walls of said screen box assembly for vibrationally isolating said screen box assembly from the ends of said rigid bar portion.

9. The screen panel mounting system of claim 1 characterized in that at least the upper portion of said rigid bar portion comprises a coating of elastomeric material, said coating of elastomeric material forming said upper contact surface.

10. The screen panel mounting system of claim 8 characterized in that said pair of support members which vibrationally isolate the ends of said rigid bar portion relative to the opposed side walls of said rigid bar assembly comprise rigid hollow members attached to the opposed sides of said screen box assembly, said rigid hollow members defining opposed recesses, each of said recesses serving to surround and support an end cap portion of said rigid bar portion which is defined by a coating or layer of elastomeric material.

11. The screen panel mounting system of claim 10 characterized in that the end portions of said rigid bar portions include relatively short transversely projecting rigid portions which are embedded in said end cap portions.

12. The screen panel mounting system of claim 8 characterized in that at least the upper portion of said rigid bar portion comprises a coating of elastomeric material, said coating of elastomeric material forming said upper contact surface; and in that said pair of support members which vibrationally isolate the ends of said rigid bar portion relative to the opposed sides of said rigid bar assembly comprise rigid hollow members attached to the opposed sides of said screen box assembly, said rigid hollow members defining opposed recesses, each of said recesses serving to surround and support an end cap portion of said rigid bar portion which is defined by a coating or layer of elastomeric material.

13. The screen panel mounting system of claim 5 characterized in that said recessed channel portion is between about 50–300% wider than the width of the contact surface portion of said vibrator bar portion.

14. The screen panel mounting system of claim 4 characterized in that the end wall portions of said screen box assembly comprise rigid cross supports which have an overlying layer of elastomeric material which has a crowned upper surface corresponding to that of said rigid bar portion of said vibrator bar assembly, said crowned upper surface of said elastomeric material serving to support the ends of said screen panel when said screen panel has its side edges forced downwardly by said hold-down means.

15. In a screen panel mounting system having a screen panel which includes a plurality of spaced wires which are welded to a series of spaced apart underlying support rod members positioned generally normal thereto so as to define a plurality of flow slots, and a screen box assembly having side walls and end wall portions for receiving and supporting said screen panel in its use position, the improvement comprising a vibrator bar assembly mounted to the opposed sides of said screen box assembly; a vibrator support plate mounted to said vibrator bar assembly intermediate its ends, said vibrator support plate being adapted to receive fastening means for attaching a vibrator thereto; said vibrator bar assembly including an elongated rigid bar portion having an upper contact surface; the ends of said rigid bar portion being vibrationally isolated from the said opposed side walls of said screen box assembly by a pair of support members attached thereto by elastomeric means; and elongated elastomeric wear strip attached to the underside of said screen panel at a location wherein it will overlie and contact the said upper contact surface of said vibrator bar assembly, said wear strip having side portions which extend downwardly past at least a portion of the upper contact surface of said rigid bar portion so as shield said contact surface from possible contact with materials passing through the flow slots of said screen panel; a pair of elongated hold-down bars positioned along the lengths of said opposed side walls of said screen box assembly, said hold-down bars being covered with elastomeric material and having a flat bottom surface which is adapted to overlie and resiliently contact the upper surface of the screen panel at the opposed sides thereof, and means on said hold-down bars cooperating with means on the sides of said screen box assembly for retaining said hold-down bars and screen panel relative to, and vibrationally isolated from, the sides of said screen box assembly.

16. The screen panel mounting system of claim 15 characterized in that said elongated rigid bar portion has a layer of elastomeric material bonded to its upper contact surface which is adapted to engage said elastomeric wear strip.

17. The screen panel mounting system of claim 16 characterized in that the upper surface of said hold-down bars includes a plurality of angled portions which are adapted to resiliently engage the undersurface of a plurality of similarly angled rigid retainer members attached to the side walls of said screen box assembly, said angled portions and said angled retainer members cooperating with each other to wedge said screen panel into its operative postion in said screen box assembly.

* * * * *